US006969195B2

(12) United States Patent
Ferranda

(10) Patent No.: US 6,969,195 B2
(45) Date of Patent: Nov. 29, 2005

(54) PACKAGE, PARTICULARLY FOR PACKING INDUSTRIAL PRODUCTS

(75) Inventor: Claudio Ferranda, Horto Florestal (BR)

(73) Assignee: Tetraquimica Industria e Comercio Ltda., Sao Paulo (BR)

( * ) Notice: Subject to any disclaimer, the term of this patent is extended or adjusted under 35 U.S.C. 154(b) by 453 days.

(21) Appl. No.: 09/966,485

(22) Filed: Sep. 28, 2001

(65) Prior Publication Data

US 2004/0118869 A1 Jun. 24, 2004

(30) Foreign Application Priority Data

Oct. 4, 2000 (BR) ..... 0004645

(51) Int. Cl.[7] ..... B65D 30/24
(52) U.S. Cl. ..... 383/44; 383/10; 383/50
(58) Field of Search ..... 383/44, 50, 53, 383/10, 125

(56) References Cited

U.S. PATENT DOCUMENTS 1,782,738 A * 11/1930 Martin ..... 383/50
2,845,214 A * 7/1958 Finke ..... 383/50
3,504,845 A * 4/1970 Niemeyer ..... 383/20
3,514,033 A * 5/1970 Goodwin ..... 383/10
5,104,235 A * 4/1992 Bronstrup et al. ..... 383/10

* cited by examiner

*Primary Examiner*—Jes F. Pascua
(74) *Attorney, Agent, or Firm*—Alston & Bird LLP

(57) ABSTRACT

One describes a package, particularly for packing industrial products, comprising a product-holding body provided with a through-bore, a grip region associated to the body and a flow controlling and interrupting valve associated to the through-bore, the valve comprising an elongate and through-bored body of flexible material, the body being fixed by means of at least its first end portion to the through-bore, the second end portion of the body, opposed to the first portion, extending outwardly of the thorough-bore and being foldable over the elongate body into the bore, so as to enable one to close the valve. The present package permits partial consumption of the product and the correct application, through the valve, thus enabling one to use the product partly and rationally, without wasting it. It also avoids leakage of the packed product, which is of great importance when toxic and polluting products are packed.

2 Claims, 3 Drawing Sheets

PACKAGE, PARTICULARLY FOR PACKING INDUSTRIAL PRODUCTS

FIELD OF THE INVENTION

The present relates to a package, particularly for packing industrial products.

BACKGROUND OF THE INVENTION

Usually, the packing of industrial absorbent or adsorbent products, for example, for containing oil spillage, was made in hermetic packages, which had to be torn or cut open. These characteristics made them particularly unsuitable when part of the product was consumed, since it was extremely difficult to preserve the rest of the product inside the package without leakage occurring.

The objective of the present invention is to provide a package for packing industrial absorbent or adsorbent products, which enables one to consume part of the product and preserve part of it inside the package, without leakage occurring. In addition, it facilitates the pouring and control of the amount of product to be poured.

SUMMARY OF THE INVENTION

The objective of the present invention is achieved by means of a package, particularly for packing industrial products, comprising a product-holding body provided with a through-bore, a grip region associated to the body and a flow controlling and interrupting valve associated to the through-bore, the valve comprising an elongate and through-bored body of a flexible material, the body being fixed by at least one first end portion thereof to the through-bore, the second end portion of the body, opposed to the first one, extending outwardly of the through-bore and being foldable over the elongate body into the bore, so as to enable one to close the valve.

The present package permits partial consumption of the product and the correct application, by means of the valve, thus enabling one to use the product partly and rationally, without wasting it. It also prevents the packed product from leaking, which is of great importance in the case of packing toxic and polluting products.

BRIEF DESCRIPTION OF THE DRAWINGS

The present invention will now be described in greater detail with reference to an embodiment represented in the drawings. The figures show.

DETAILED DESCRIPTION OF THE INVENTION

Figure 1:
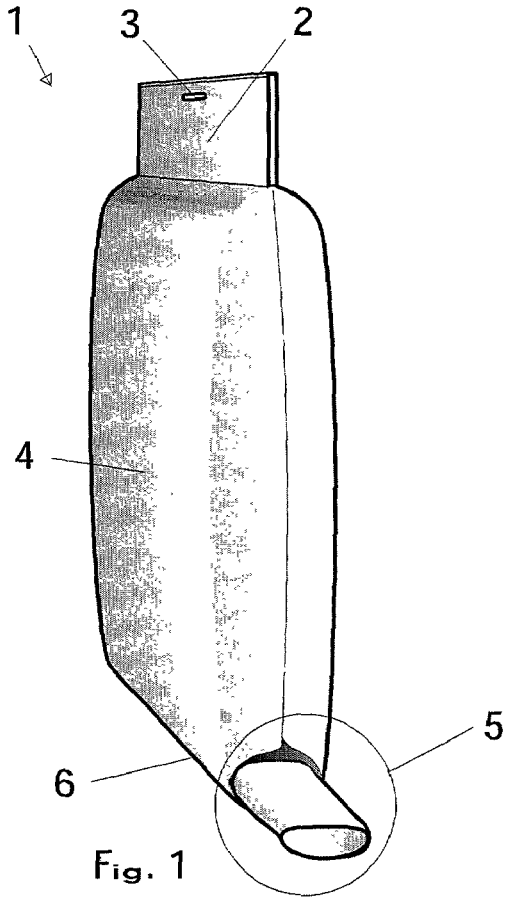
FIG. 1 is a perspective view of the package of the present invention.
Figure 2:
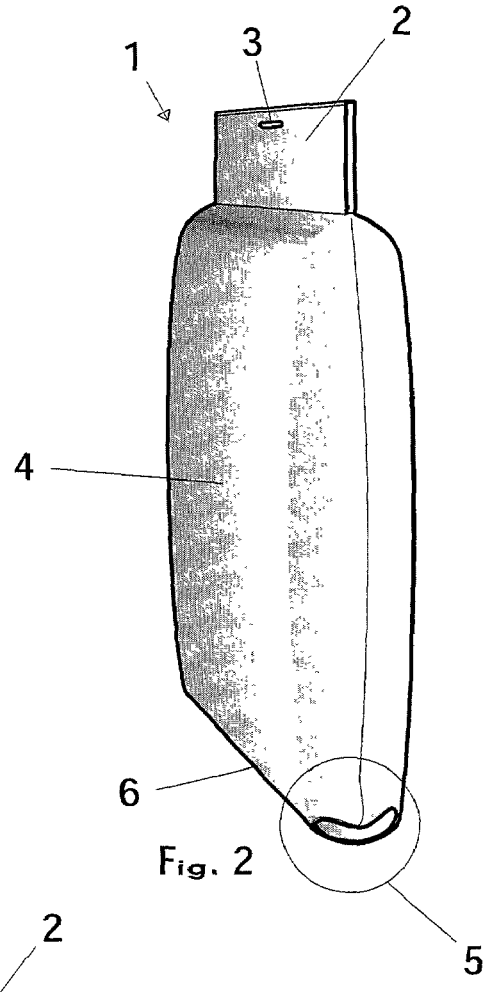
FIG. 2 is a second perspective view of the package of the present invention.
Figure 3:
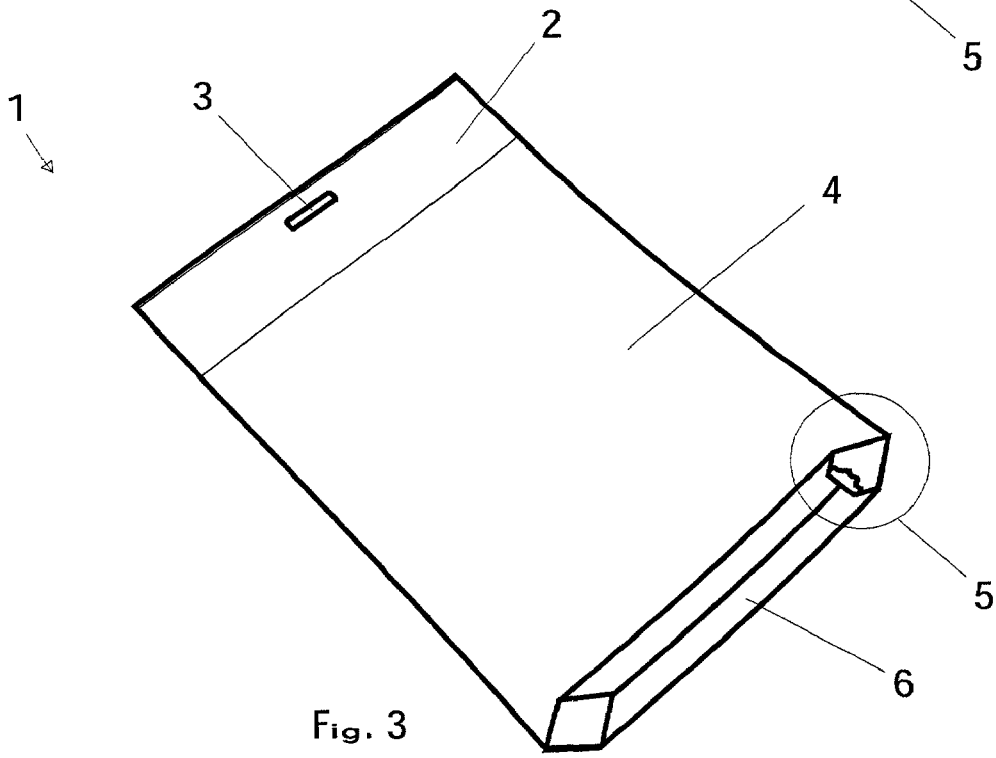
FIG. 3 is a perspective schematic view of the package of the present invention when empty.
Figure 4:
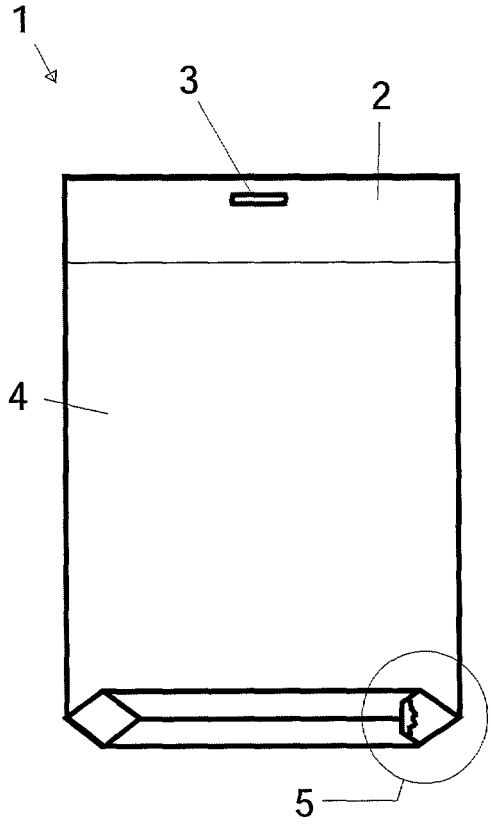
FIG. 4 is a perspective front view of the package illustrated in FIG. 3.
Figure 5:
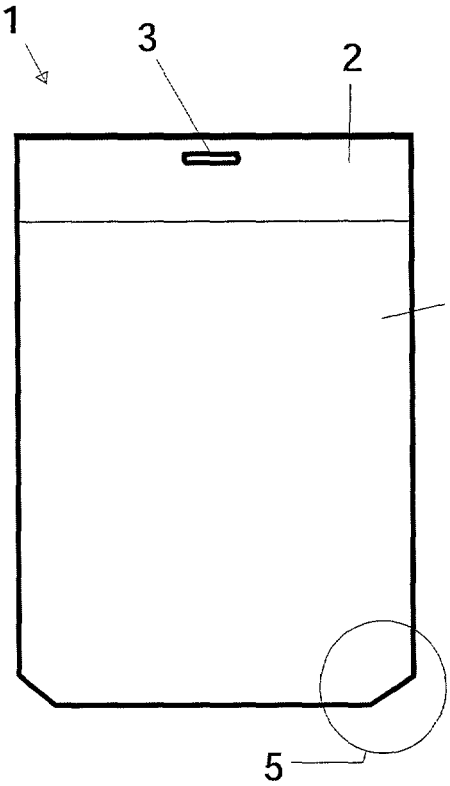
FIG. 5 is a schematic back view of the package illustrated in FIGS. 3 and 4.
Figure 6:
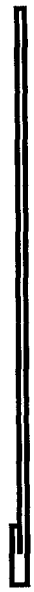
FIG. 6 is a schematic side view of the package illustrated in FIGS. 3–5.
Figure 7:
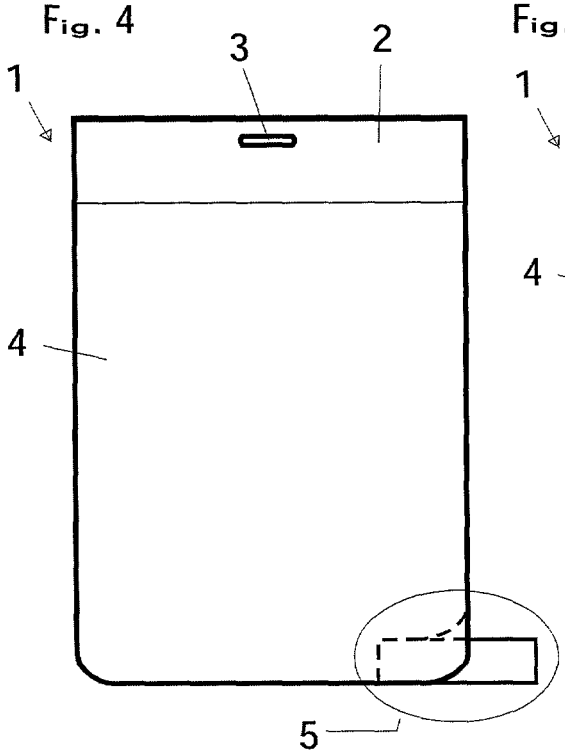
FIG. 7 is a schematic view of the package of the present invention when the flow controlling and interrupting valve is open.
Figure 8:
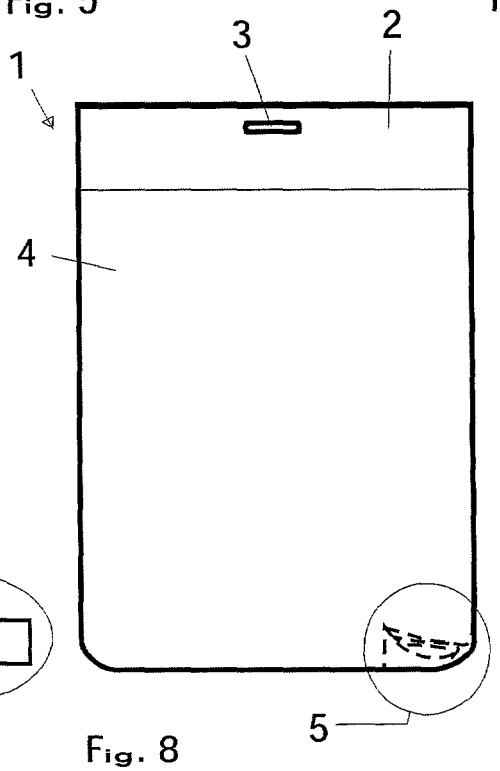
FIG. 8 is a schematic view of the package of the present invention when the flow controlling and interrupting valve is closed.
Figure 9:
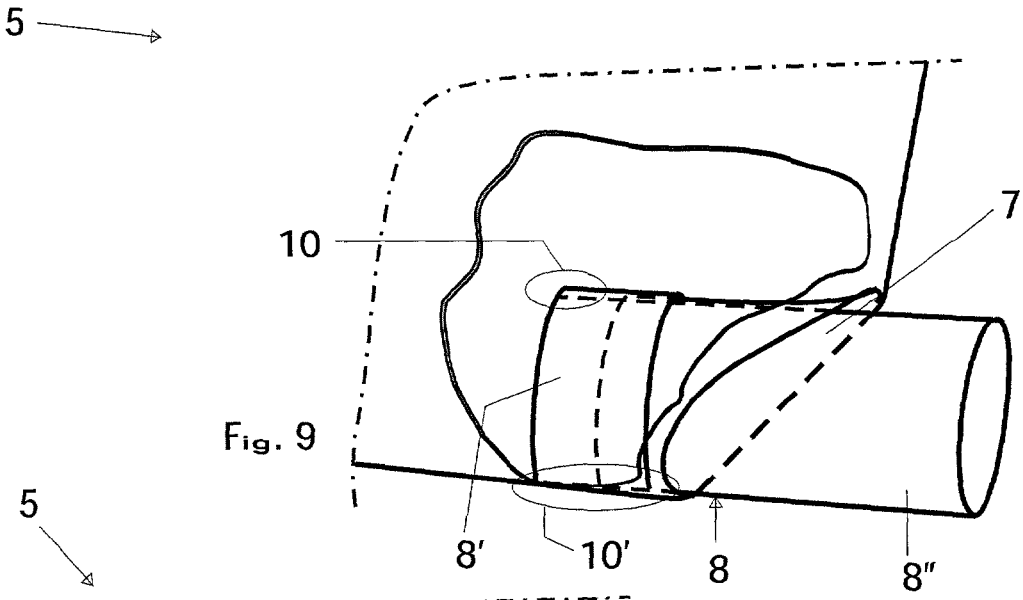
FIG. 9 is a cross-section view of the flow controlling and interrupting valve in the open position.
Figure 10:
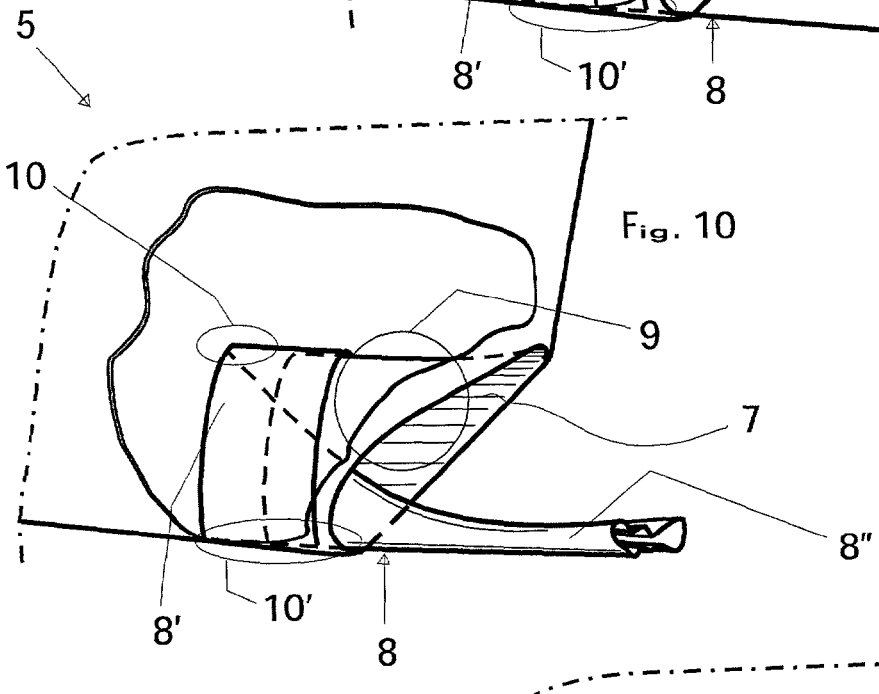
FIG. 10 is a cross-section view of the valve illustrated in FIG. 9 when in closing position.
Figure 11:
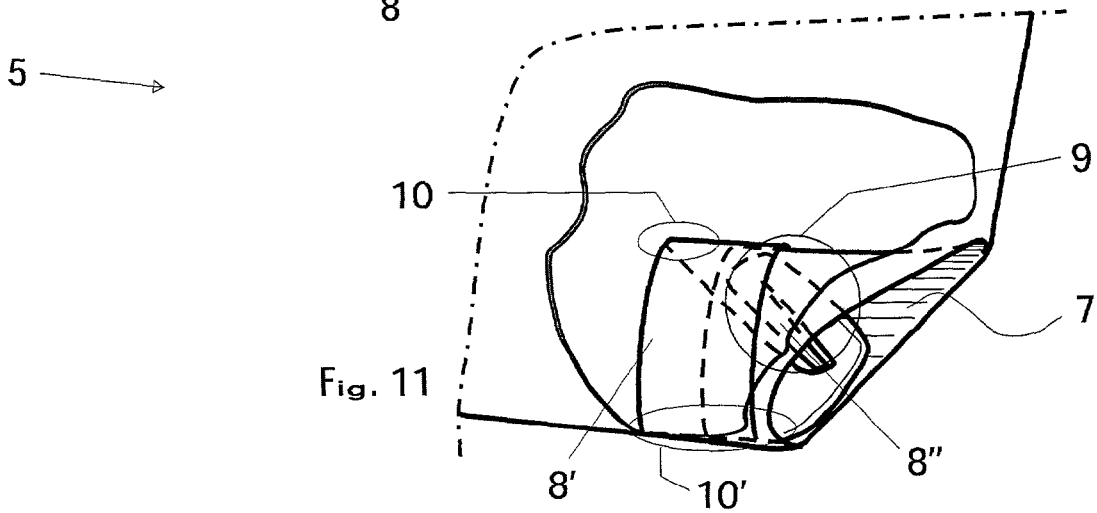
FIG. 11 is a cross-section of the valve illustrated in FIGS. 9 and 10 when it is in the closed position.

According to a preferred embodiment and as can be seen from FIG. 1, the package 1 of the present invention, for packing industrial absorbent or adsorbent products, comprises a first end portion 2 or grip portion 2, a second end portion 6, a product-holding body 4, and a flow controlling and interrupting valve 5. The first end portion 2 is substantially rectangular, being provided with at least one, but preferably four overlapped layers of substantially flexible and substantially impermeable material. In a substantially central region of this first end portion 2, a substantially oblong through-opening 3 is provided, the function of which is to enable the user to grip and handle the package.

The body 4 of the package comprises two layers of substantially flexible and substantially impermeable material, substantially rectangular, joined to each other at their main edges, which are substantially parallel to the direction of the longitudinal length of the package 1. Each of the layers described above has also a first secondary edge, to which the first end portion 2 is associated, and a second secondary edge, located substantially parallel and opposite to the first one. Like the main edges, the first secondary edges of the above layers are joined to each other and to the first end portion 2. Therefore, both layers of substantially flexible and substantially impermeable material, substantially rectangular, define a sac or bag, where the industrial absorbent or adsorbent products may be packed.

On the other hand, the main edges of the layers described in the preceding paragraph are joined to each other with excess material between them, so that the excess material defines a second end portion 6 that is substantially rectangular and substantially perpendicular to the two layers of substantially flexible and impermeable material. A first end portion of this second end portion 6 meets the fixation end portion of two of the main layers of substantially flexible and impermeable material. A second end portion of this second end portion 6 comprises a substantially tubular through-bore 7, with the direction of its longitudinal geometric axis being substantially perpendicular to the direction of the longitudinal geometric axis of the package 1. The bore 7 is defined by the wall of the layers of substantially flexible and impermeable material and additionally comprises the flow controlling and interrupting valve 5.

The valve 5 is constituted by a substantially cylindrical tube 8 of a transparent material, which has its first end portion 8' associated to a first lateral end region of the tubular through-bore 7, or first fixation region 10. When the package 1 is in vertical position, with the first end portion 2 facing upwards, the first fixation region 10 is being defined here as its upper portion. The bore 7 also comprises a second lateral end region or second fixation region 10', which is substantially opposed to the first one. The association of the tube 8 with the first fixation region 10 is effected at a first end portion 8' of the tube 8, with respect to the inside of the package 1, and the association of the tube 8 with said second fixation region 10' is effected substantially over the whole region of contact between both, the second region 10' being substantially larger than the first region 10. Therefore, there is a descending channel for filling the package at the factory and for pouring the packed product. In addition, the tube 8 comprises a second end portion in the form of a substantially free portion or stretch 8", without any association with the package 1. In this way, the free stretch 8" may be folded and/or directed as required or desired. Once the association of the tube 8 with the first end portion 2 is effected at the first end portion of the tube 8' with respect to the inside of the package 1, a cavity 9 is provided to permit this folding. The cavity 9 is defined by the region inside the through-bore 7, where there is no fixation between the tube 8 and the through-bore 7.

In order to close the valve 5, it is enough to fold the free stretch 8" described above over the rest of the length of the tube 8, which is possible by virtue of the length of this free stretch 8". To corroborate the tightness, the weight of the packed product crushes both stretches of the tube 8, thus contributing to obstruct the passage completely. When one desires to use the product contained in the package 1, it is enough to unfold the free stretch 8". This process may be repeated several times, guaranteeing utilization flexibility to the package 1.

Evidently, other materials may be used in the manufacture of any of the components of the present invention, provided that they are functional. In addition, other configurations of the valve 5 may be foreseen, without altering the protection scope of the invention with respect to the preferred embodiment described here.

The present package 1 permits partial consumption of the product and the correct application, by means of the valve 5, facilitating the pouring and control of the desired amount of product, thus enabling one to use the product partly and rationally, without wasting it. It also avoids leakage of the packed product, which is of great importance if toxic or polluting products are packed.

A preferred embodiment having been described, one should understand that the scope of the present invention embraces other possible variations, being limited only by the contents of the accompanying claims, which include the possible equivalents.

That which is claimed:

1. A package, particularly for packing industrial products, comprising a product-holding body provided with a through-bore, a grip region associated to the body and a flow controlling and interrupting valve associated to the through-bore, the valve comprising an elongate and through-bored body of flexible material, the elongate and through-bored body being fixed by means of at least one first end portion thereof to the through-bore, one second end portion of the elongate and through-bored body, being opposed to the first portion, extending outwardly of the through-bore and being foldable over the elongate and through-bored body into the through-bore, so as to enable one to close the valve, the second end portion of the elongate and through-bored body being selectively foldable in the direction of the first region inside a cavity defined between the valve and the product-holding body, wherein the valve is positioned opposite the product-holding body from the grip region;

the second end portion of the elongate and through-bored body is configured to be folded inwardly into the cavity, such that the weight of a product disposed in the product-holding body crushes the end portions of the tube when the valve is folded into the through-bore and the package is lifted by the arm region;

the elongate and through-bored body is fixed to an internal portion of the through-bore by means of first and second opposed fixation regions, the second region being substantially larger than the first region;

the fixation between the elongate and through-bored body and the internal portion of the through-bore in the second region is effected substantially over the whole region of contact between them both; and the valve is configured to remain folded even when subjected only to its own weight.

2. A package according to claim 1, wherein the elongate and through-bored flexible body has a substantially tubular shape.

* * * * *